US005927765A

United States Patent [19]

Austin et al.

[11] Patent Number: 5,927,765

[45] Date of Patent: Jul. 27, 1999

[54] DOGGING DEVICE FOR A LATCH ASSEMBLY

[75] Inventors: Marlin D. Austin, Speedway; Richard B. Cohrs, Jr., New Palestine; Stephen M. Rohrbaugh, Indianapolis, all of Ind.

[73] Assignee: Von Duprin, Inc., Indianapolis, Ind.

[21] Appl. No.: 08/987,930

[22] Filed: Dec. 10, 1997

Related U.S. Application Data

[60] Provisional application No. 60/038,301, Feb. 21, 1997.

[51] Int. Cl.[6] ..... E05B 65/10

[52] U.S. Cl. ..... 292/92; 292/336.3; 292/194; 292/229

[58] Field of Search ..... 292/194, 229, 292/200, 202, 29, 31, 52, 54, 100, 101, 11, 92, 336.3, 210, 153, 207; 403/154, 155, 329; 24/570, 563, 458; 70/92

[56] References Cited

U.S. PATENT DOCUMENTS

| | | | |
|---|---|---|---|
| 2,778,597 | 1/1957 | Haumerson | 403/329 |
| 3,614,145 | 10/1971 | Zawadzki | 292/92 |
| 3,686,616 | 8/1972 | Bowerman | 24/697.1 |
| 3,749,434 | 7/1973 | Gley | 292/128 |
| 3,854,763 | 12/1974 | Zawadzki et al. | 292/201 |
| 4,142,391 | 3/1979 | Paig | 70/461 |
| 4,466,643 | 8/1984 | Godec et al. | 292/92 |
| 4,578,849 | 4/1986 | Kaufman | 403/155 |
| 5,123,541 | 6/1992 | Giannini et al. | 24/458 |
| 5,169,185 | 12/1992 | Slaybaugh et al. | 292/92 |
| 5,184,852 | 2/1993 | O'Brien | 292/40 |
| 5,189,766 | 3/1993 | Weber | 24/459 |
| 5,497,536 | 3/1996 | Hart | 24/459 |
| 5,564,760 | 10/1996 | Mader | 292/336.3 |

*Primary Examiner*—Suzanne Dino Barrett
*Assistant Examiner*—Teri Pham
*Attorney, Agent, or Firm*—Michael H. Minns

[57] ABSTRACT

A dogging device for securing a panic exit and actuation device in an unlatched condition. The dogging device uses a U-shaped spring clip to secure a base plate, a dogging adapter and a dogging hook together. The base plate, dogging adapter and dogging hook are rotated about a common axis by an operator, which can either be a hex shaft or a cylinder adapter operated by a keyed lock, from a disengaged position to an engaged position where the dogging hook engages a control rod of the exit device thereby holding, or dogging, the exit device in an unlatched condition. An over center spring is used to bias the dogging hook into either the engaged or the disengaged position.

25 Claims, 5 Drawing Sheets

DOGGING DEVICE FOR A LATCH ASSEMBLY

This application claims the benefit under 35 U.S.C. §119(e) of United States Provisional application Ser. No. 60/038,301, filed Feb. 21, 1997.

BACKGROUND OF THE INVENTION

This invention relates generally to dogging devices and more particularly to dogging devices used with panic exit and actuator assemblies.

The dogging function of an exit device on a door secures the active bar of the exit device in the depressed position with the device latching bolt retracted. Activating a dogging device is accomplished by depressing the active bar and rotating a hex wrench clockwise through a hole adjacent to the bar. This action will hold the depressed bar and retracted latch until the dogging function is deactivated. Another method to activate the dogging device is cylinder dogging where the hex wrench is replaced with a locking cylinder. In the dogged state, egress may be gained by pulling from the outside of the door or pushing from the inside. A dogged device now permits heavy traffic to egress from the previously locked exterior without the actuation of levers, knobs or key cylinders. Dogging devices in high traffic applications will reduce the potential for wear by disabling all moving parts.

Current dogging devices require disassembly to convert the dogging device from a hex shaft to a locking cylinder. It is possible to assemble the dogging device incorrectly, which can render the dogging device inoperable.

The foregoing illustrates limitations known to exist in present dogging devices. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a dogging device for a latch assembly having a translating latching and unlatching control rod, comprising: a dogging hook having a hook portion thereon, the dogging hook being pivotable about an axis between a first position engaging the latching and unlatching control rod and a second position not engaging the latching and unlatching control rod; an operator co-axial with the dogging hook axis and engaging the dogging hook; a spring biasing the dogging hook in either of the first or Second positions; and a clip means for axially retaining the operator and the dogging hook.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
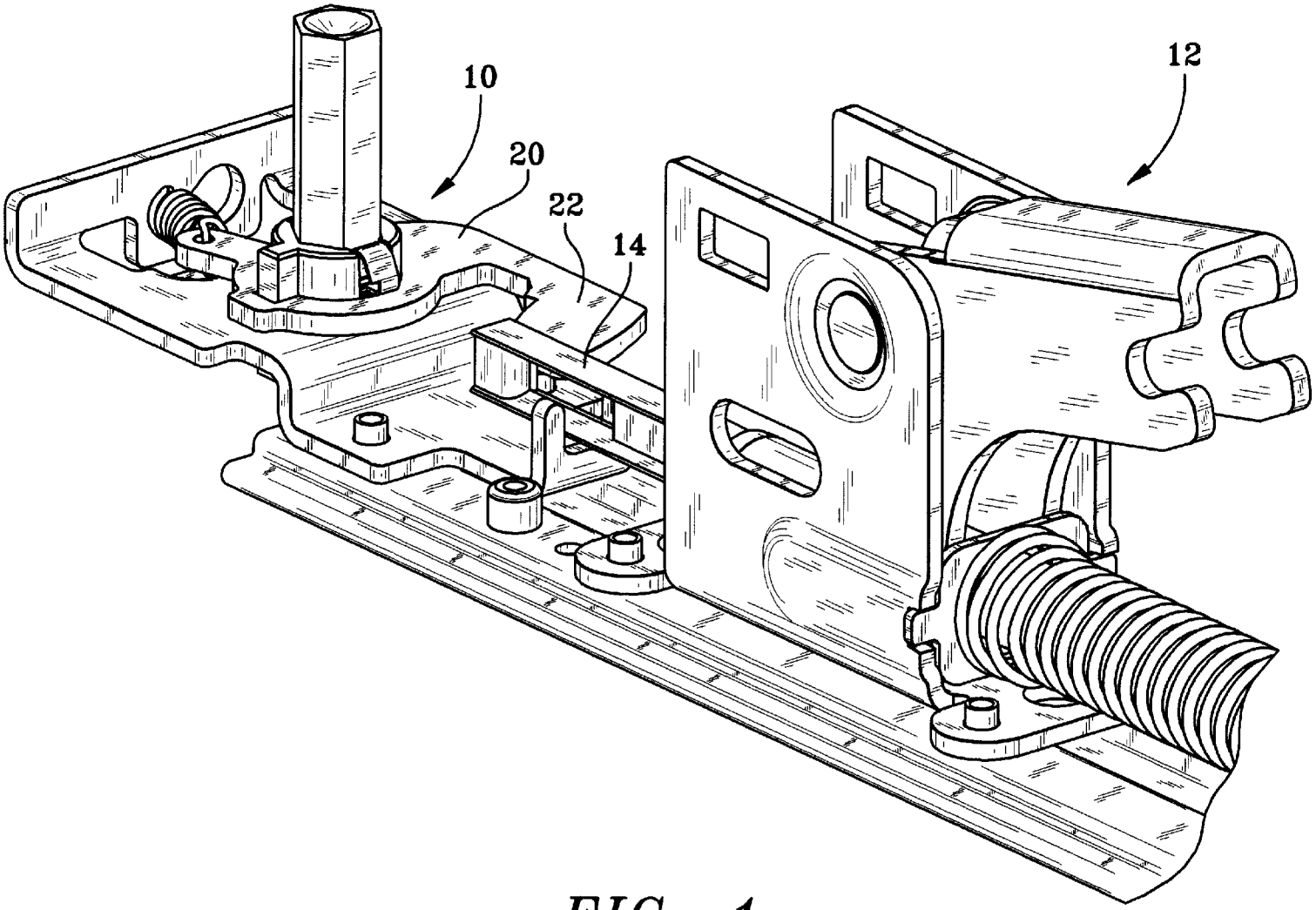
FIG. 1 is a partial perspective of a typical exit device showing the dogging device of the present invention.
Figure 2:
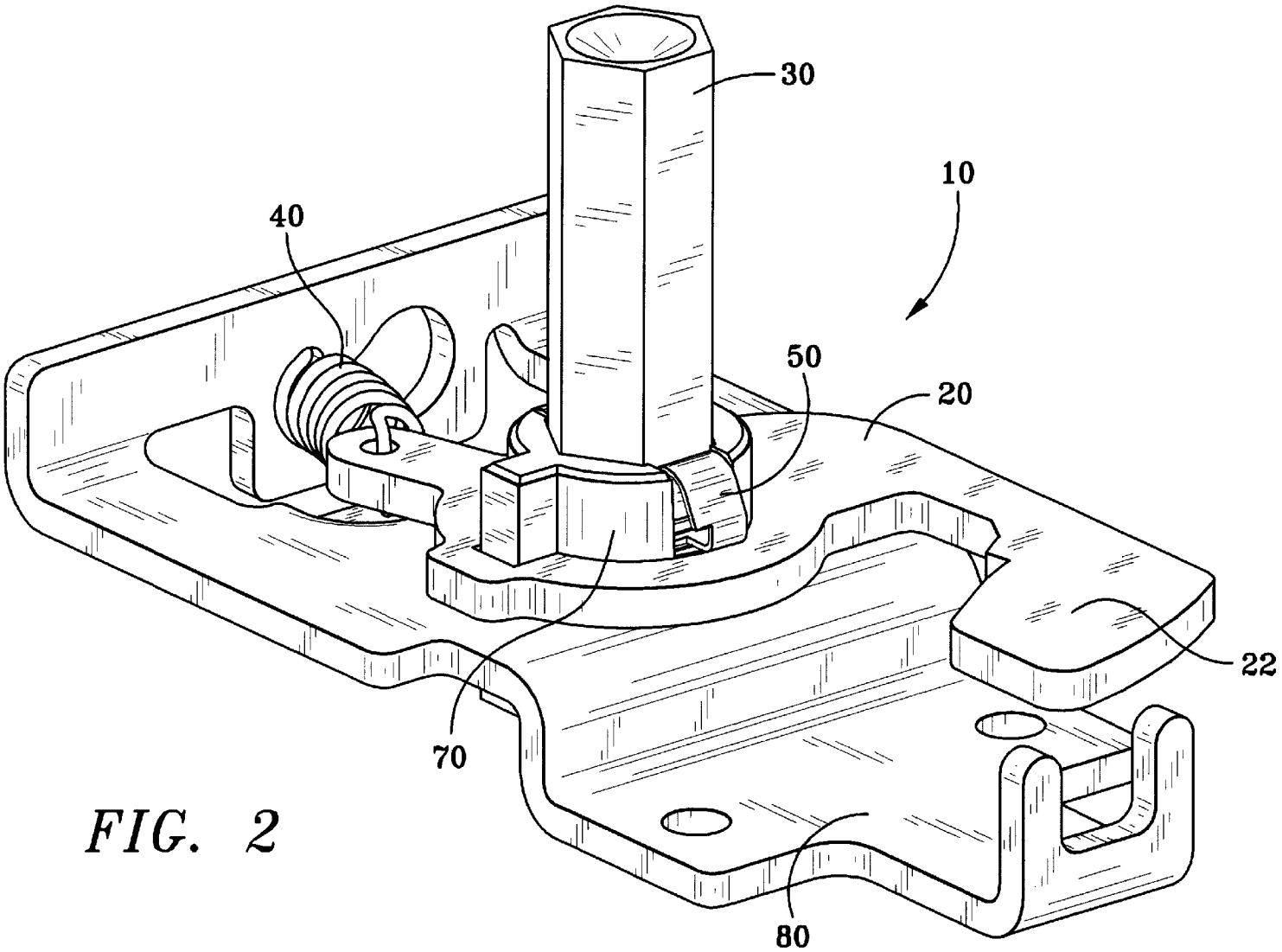
FIG. 2 is a perspective view of the dogging device shown in FIG. 1.

FIG. 1 shows a perspective view of a dogging device 10 for use with a latch assembly 12. The dogging device 10 has a dogging hook 20 which is rotatable between an engaging position where the dogging hook 20 engages a laterally moveable latching and unlatching control rod 14 on the latching assembly. When in the engaging position, the engagement of the dogging hook 20 holds the control rod 14 in position which in turn holds the active bar (not shown) of the latch assembly 12 depressed and the latching bolt (not shown) of the latch assembly retracted, i.e., "dogged".

The dogging device 10 includes the dogging hook 20, which has a hook portion 22 for engaging the control rod 14, an aperture 24 with an engaging keyway 26 for keyed engagement with a dogging adapter 70. The dogging adapter 70 consists of a cylindrical body 71 having an axially extending opening 72 therein. In the preferred embodiment, the axial opening 72 is hex-sided as shown in the FIGURES. The dogging adapter 70 has a shoulder portion 73 at its base for engaging the lower surface of a dogging plate 80. The dogging adapter 70 further has an axially extending key 74 on the outside of the cylindrical body 71. A U-shaped spring or clip 50 inserts into the dogging adapter 70. The U-shaped spring 50 engages the dogging hook 20 and an operator 30, 60. The U-shaped spring 50 axially retains the dogging hook 20, the dogging adapter 70 and the operator 30, 60. An over center spring 40 biases the dogging hook 20 in either of the engaged or disengaged positions.

In one embodiment, the operator 30, 60 is a hex shaft 30. The hex shaft 30 is chamfered at the base for easy insertion over the U-shaped spring clip 50. The hex shaft 30 has a groove 32 for engagement by the U-shaped spring clip 50. An internal hex in the top of the shaft accepts a 5/32 Allen wrench.

In a second embodiment, the operator 30, 60 is a cylinder adapter 60. The cylinder adapter 60 consists of a plate 62 having central aperture 66 with a pair of opposed notches 68 extending from the aperture 66 and a keyway 69 also extending from the aperture 66. The keyway 69 mates with the dogging adapter key 74. The notches 68 allow the cylinder adapter 60 to snap into position by engaging the free ends of the U-shaped spring clip 50. The cylinder adapter has two upstanding arms 64, which engage a rotatable tongue (not shown) of a locking and unlocking device (not shown).

The dogging plate 80 is the base of the dogging device 10. The dogging plate 80 has an aperture 82 through which the dogging adapter 70 and U-shaped spring clip 50 are inserted. Extending from the dogging plate aperture 82 is a limiting keyway 89 which interacts with the dogging adapter key 74 to limit the rotation of the dogging adapter 70 and attached dogging hook 20. One end of the dogging plate 80 has a first upturned portion 84 with cutout 88 for attachment of one end of spring 40. The other end of the dogging plate 80 has a second upturned portion 86 with forked section or guides 87 to restrain the side to side movement of the control rod 14 during engagement. An embossed section 83, the depressed portion, helps prevent installing spring 40 upside down. Cutout 88 is shaped with an approximate hourglass shape, i.e., a circular portion connected to a transversely extending approximately rectangular portion, to simplify installation of the spring 40 and retain a loop end 44 of the spring 40.

The spring 40 is an over center spring formed from a compression spring. Load is transferred across the spring 40 from the last coil at the looped end 44 against the dogging plate 80 and through the coils to the wire form end 42. The wire formed end 42 has an extension from the coils to provide clearance for the operation of the dogging hook 20. After this extension, a vertical form in the wire form end 42 is used to transfer the load to the dogging hook 20. The small bend at the end of the wire form end 42 prevents the spring 40 from disengaging from the dogging hook 20. The opposite end of the spring 40 contains a long loop, which serves as a handle for installation as well as a positioning aid. Because the load of the spring 40 is highest when the dogging hook 20 is in the center of its travel, the dogging hook 20 in unstable, which results in the spring 40 biasing the dogging hook 20 in either of the engaged or disengaged positions.

The dogging hook 20 has a center aperture 24 with an engaging keyway 26 extending therefrom. The combination of keyway 26, the shape of the dogging hook 20 and the dogging adapter key 74 only allows the dogging hook 20 to be assembled onto the dogging adapter 70 in one way, thereby preventing incorrect assembly. Because the control rod 14 may have several operating positions, the hook portion 22 is contoured to form one or more steps which allow the dogging hook 20 to engage control rod 14 in a plurality of positions.

The U-shaped spring clip 50 contains bends at the free ends of the spring 50 that form retaining heads 52. These retaining heads 52 cause the U-shaped spring clip 50 to retain itself in the dogging adapter 70 after the spring 50 is installed into the dogging adapter 70. The curvature at the top of the retaining heads 52 allow for easy insertion of the dogging hook 20 and the hex shaft 30. The flats, approximately right angle surfaces at the bottom the retaining heads 52, make these parts more difficult to remove. The bottom of the U-shaped spring clip 50 has a widened base portion 56 which abuts the underside of the dogging adapter 70 to prevent the spring clip 50 from being pushed completely through the dogging adapter axial opening 72. Each retaining head 52 has a small notch 54 that interacts with the cylinder adapter notches 68 retaining the cylinder adapter 60 on the dogging adapter 70.

Figures 3, 3A:
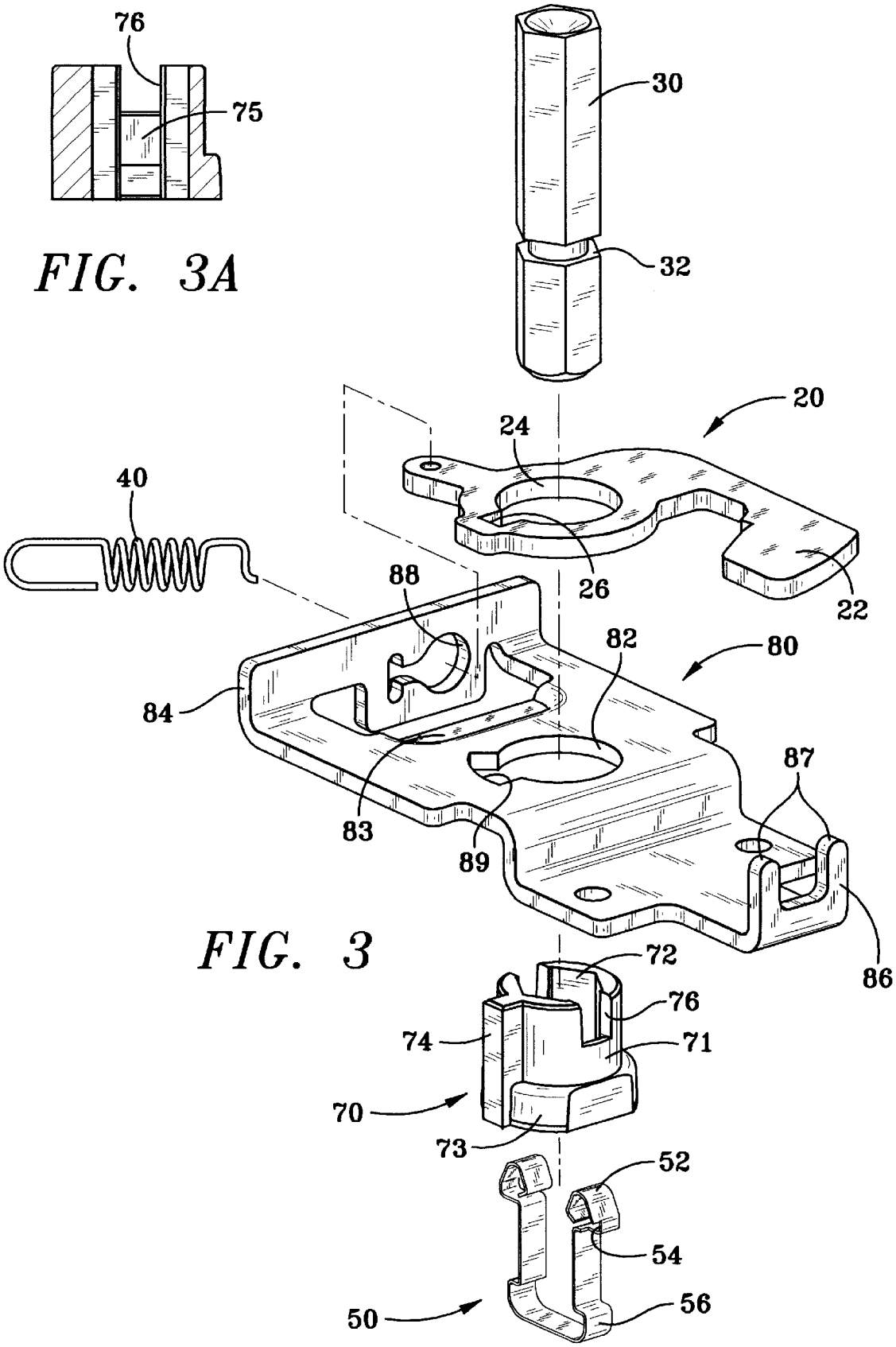
FIG. 3 is an exploded perspective view of the dogging device shown in FIG. 2.
FIG. 3A is a cross-sectional view of a dogging adapter.
Figure 4:
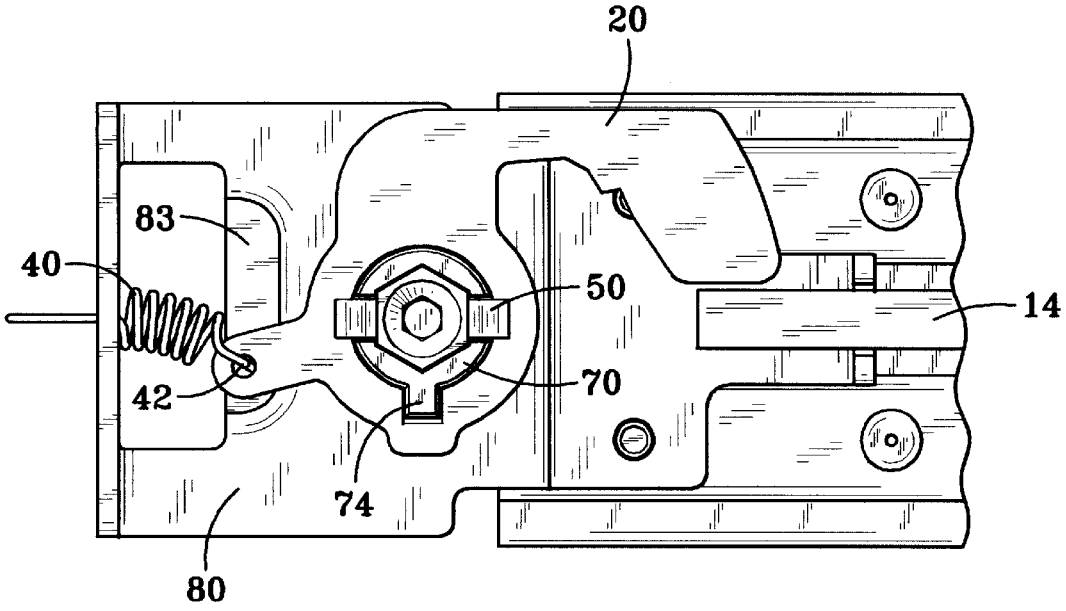
FIG. 4 is a plan view of the dogging device shown in FIG. 2.
Figure 5:
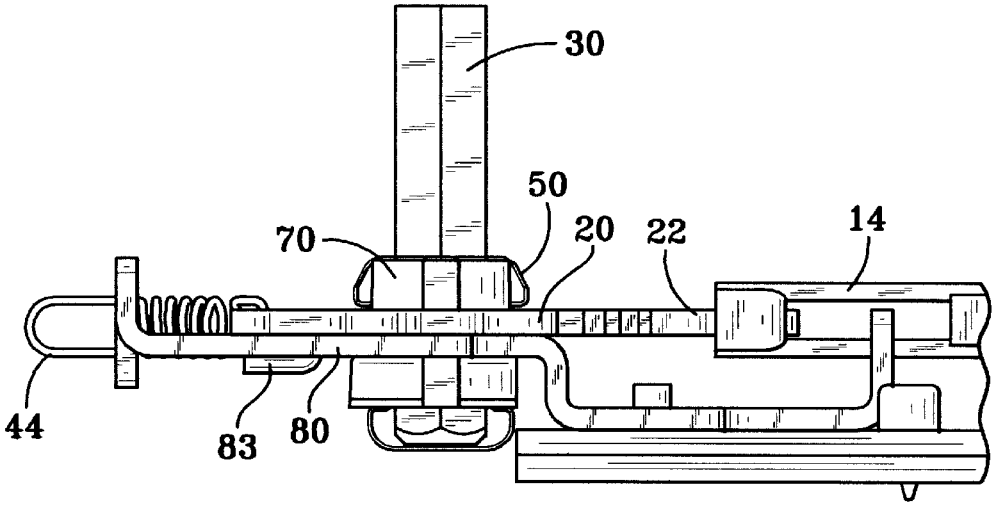
FIG. 5 is side view of the dogging device shown in FIG. 2.

The U-shaped spring clip 50 is inserted through the bottom of the dogging adapter 70 and snaps into two opposed slots or grooves 75 on the inside of the dogging adapter axial opening 72. The retaining heads 52 fit into two dogging adapter notches 76 at the upper ends of grooves 75 (FIG. 3A). With the U-shaped spring clip 50 in place, the dogging plate 80 is placed over the spring clip retaining heads 52 and onto the shoulder 73 of the dogging adapter 70. When the dogging hook 20 is placed over the dogging adapter 70, the U-shaped spring clip 50 will snap back, thereby axially securing all three components, dogging hook 20, dogging adapter 70, and spring clip 50. The hex shaped hole 72 in the center of the dogging adapter 70 accepts the hex shaft 30.

Figure 6:
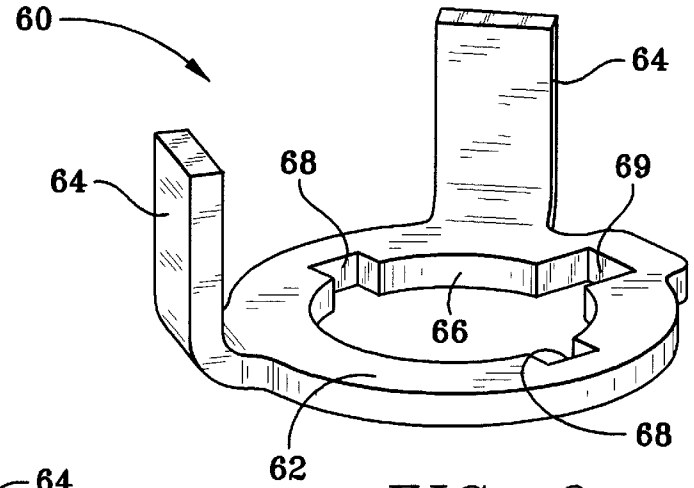
FIG. 6 is a perspective view of a cylinder adapter for use with the dogging device shown in FIG. 2.
Figure 7:
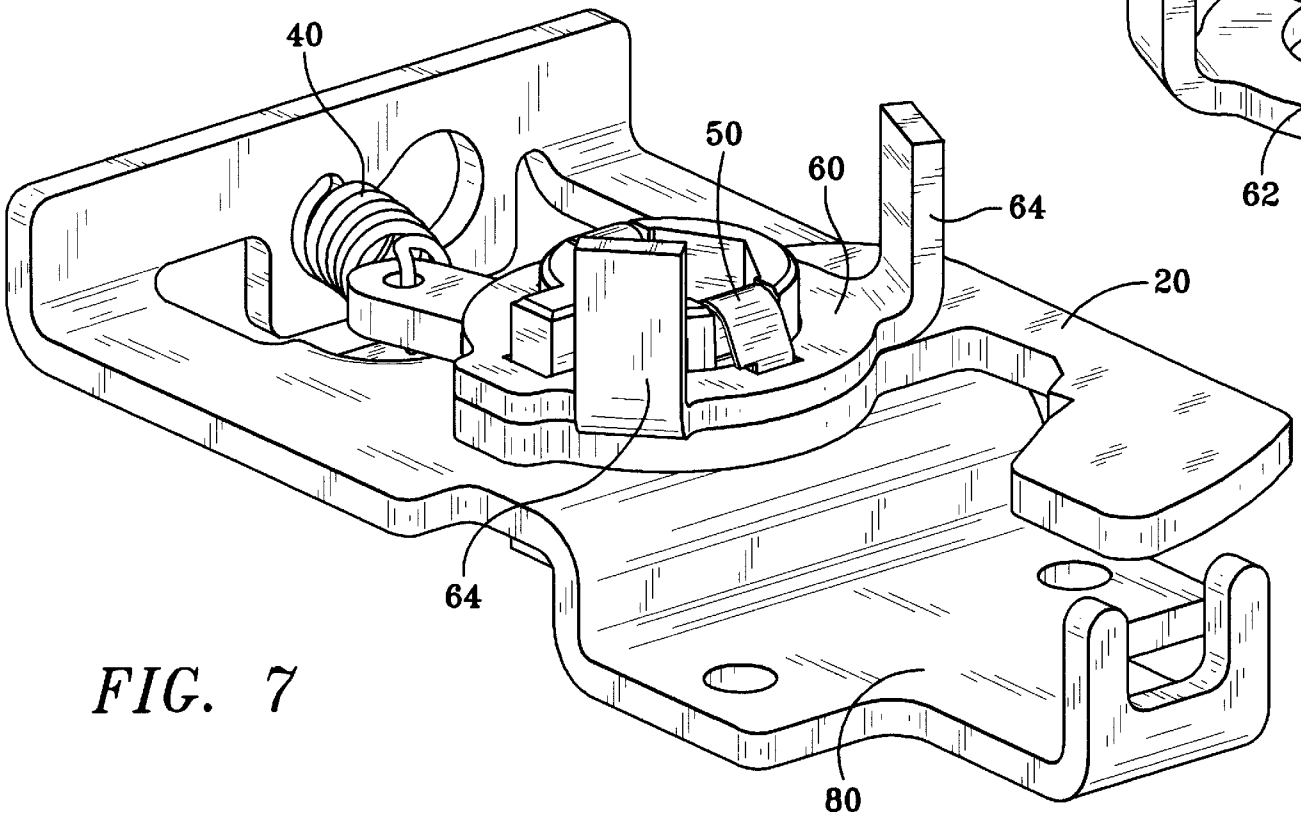
FIG. 7 is a perspective view of the dogging device shown in FIG. 2 with the cylinder adapter shown in FIG. 6 in place of a hex operator shaft.

The dogging device 10 allows for easy field conversion from hex dogging (FIGS. 1 through 5) to cylinder dogging (FIGS. 6 and 7). First, remove the latch assembly 14 endcap and coverplate (not shown) and pull the hex shaft 30 straight out. Take a cylinder adapter 60 and press over the U-shaped spring clip 50. Because of the cylinder adapter keyway 69 and the cylinder adapter upstanding arms 64, the cylinder adapter 60 can only be installed one way. The endcap is the replaced along with a coverplate having a locking and unlocking device installed in the coverplate.

To operate the dogging device 10 having a hex shaft 30 installed, first, the latching assembly 12 is operated to depress the active bar (not shown) and retract latching bolt (not shown) and to move the control rod 14 towards the dogging device 10. Then, a hex Allen wrench through a hole in the latch assembly 12 coverplate and into the hex shaped hole in the hex shaft 30. The Allen wrench is rotated, causing the hex shaft 30 rotate, thereby rotating the dogging hook 20 from a disengaged position to an engaged position where the hook portion 22 of the dogging hook 20 engages the control rod 14. After the Allen wrench is removed, the over center spring 40 will bias (or keep) the dogging hook 20 in the engaged position where the dogging hook 20 will prevent the control rod 14 from disengaging from the dogging device 10 and thereby keep the active bar depressed and the latching bolt retracted, i.e., dogging the latching device 12 in an open condition.

Having described the invention, what is claimed is:

1. A dogging device for a latch assembly having a translating latching and unlatching control rod, comprising:

a dogging hook having a hook portion thereon, the dogging hook being pivotable about an axis between a first position adapted to engage the latching and unlatching control rod and a second position adapted to not engage the latching and unlatching control rod;

an operator co-axial with the dogging hook axis and engaging the dogging hook;

a spring biasing the dogging hook in either of the first or second positions; and an axially extending clip means for axially retaining the operator and the dogging hook.

2. The dogging device according to claim 1, wherein the axially extending clip means comprises a U-shaped spring.

3. The dogging device according to claim 2, wherein each end of the U-shaped clip has a retaining head thereon, the retaining heads engaging the operator and the dogging hook.

4. The dogging device according to claim 3, wherein the operator is a cylinder adapter comprising a plate having a pair of upstanding arms adapted to engage a rotatable tongue of a locking and unlocking device, the plate having a central aperture therein and a pair of notches extending from the central aperture, the retaining heads engaging the plate notches.

5. The dogging device according to claim 4, wherein each retaining head has a notch portion therein.

6. The dogging device according to claim 1, wherein the operator is a multi-sided shaft.

7. The dogging device according to claim 6, wherein the multi-sided shaft has a groove therein, the axially extending clip means engaging the groove.

8. The dogging device according to claim 1, wherein the operator is a cylinder adapter comprising a plate having a pair of upstanding arms adapted to engage a rotatable tongue of a locking and unlocking device.

9. The dogging device according to claim 1, further comprising:

a dogging adapter comprising a cylindrical body having a multi-sided axial opening therethrough, a shoulder portion at one end thereof and an axially extending key on the outside thereof, the dogging adapter engaging the operator.

10. The dogging device according to claim 9, wherein the axially extending clip means comprises a U-shaped spring, the U-shaped spring being inserted into the dogging adapter axial opening.

11. The dogging device according to claim 1, further comprising:

a dogging plate, the dogging plate having an aperture therein and having a first upturned portion, the axially extending clip means extending through the aperture, and the spring being connected to the dogging plate first upturned portion and the dogging hook.

12. The dogging device according to claim 11, wherein the dogging plate has a second upturned portion having two guides extending therefrom for guiding the latching and unlatching control rod.

13. The dogging device according to claim 11, wherein the first upturned portion has a cutout for retaining an end of the spring.

14. The dogging device according to claim 13, wherein the cutout has a first part having a circular shape connected to a rectangular shape, a long side of the rectangular shape extending transversely to the circular shape.

15. A dogging device for a latch assembly having a translating latching and unlatching control rod, comprising:

a dogging adapter comprising a cylindrical body having an axial opening therethrough, and a shoulder portion at one end;

a dogging plate, the dogging plate having an aperture therein, the dogging adapter extending through the dogging plate aperture;

a dogging hook having a hook portion thereon, the dogging hook being pivotable about an axis between a first position adapted to engage the latching and unlatching control rod and a second position adapted to not engage the latching and unlatching control rod, the dogging hook engaging the dogging adapter;

an operator co-axial with the dogging hook axis and engaging the dogging adapter;

a biasing spring biasing the dogging hook in either of the first or second positions; and a U-shaped spring clip axially retaining the dogging adapter, the operator and the dogging hook.

16. The dogging device according to claim 15, wherein the U-shaped spring clip engages the dogging adapter, the operator and the dogging hook.

17. The dogging device according to claim 15, wherein the U-shaped spring clip extends through the dogging adapter aperture.

18. The dogging device according to claim 15, wherein the dogging adapter has a pair of opposed axially extending grooves therein.

19. The dogging device according to claim 15, wherein the dogging adapter axial opening is multi-sided.

20. The dogging device according to claim 15, wherein the biasing spring is connected to the dogging plate and the dogging hook.

21. The dogging device according to claim 15, wherein the dogging adapter has an external key extending axially thereon, the dogging plate has a limiting keyway extending from the dogging plate aperture for engaging the dogging adapter key and for limiting rotation of the dogging adapter and dogging hook.

22. The dogging device according to claim 21, wherein the dogging hook has an aperture therein and has an engaging keyway extending therefrom, the dogging adapter extending through the dogging hook aperture, the dogging adapter key engaging the engaging keyway.

23. The dogging device according to claim 15, wherein the operator is a multi-sided shaft.

24. The dogging device according to claim 15, wherein the operator is a cylinder adapter comprising a plate having a pair of upstanding arms adapted to engage a rotatable tongue of a locking and unlocking device.

25. A dogging device for a latch assembly having a translating latching and unlatching control rod, comprising:

a dogging adapter comprising a cylindrical body having an axial opening therethrough, a shoulder portion at one end thereof and an axially extending key on the outside thereof;

a dogging plate, the dogging plate having an aperture therein and a limiting keyway extending from the aperture for engaging the dogging adapter key and for limiting rotation of the dogging adapter and dogging hook, the dogging adapter extending through the dogging plate aperture;

a dogging hook having a hook portion thereon, the dogging hook being pivotable about an axis between a first position adapted to engage the latching and unlatching control rod and a second position adapted to not engage the latching and unlatching control rod, the dogging hook engaging the dogging adapter, the dogging hook having an aperture therein and having an engaging keyway extending from the aperture, the dogging adapter extending through the dogging hook aperture, the dogging adapter key engaging the engaging keyway;

an operator co-axial with the dogging hook axis and engaging the dogging adapter;

a biasing spring being connected to the dogging plate and the dogging hook, the biasing spring biasing the dogging hook in either of the first or second positions; and a U-shaped spring clip extending through the dogging adapter aperture and engaging and axially retaining the dogging adapter, the operator and the dogging hook.

* * * * *